US005517951A

United States Patent [19]

Paul et al.

[11] Patent Number: 5,517,951

[45] Date of Patent: May 21, 1996

[54] TWO STROKE/FOUR STROKE ENGINE

[76] Inventors: Marius A. Paul; Ana Paul, both of 1120 E. Elm Ave., Yorba Linda, Calif. 92686

[21] Appl. No.: 349,732

[22] Filed: Dec. 2, 1994

[51] Int. Cl.[6] ..... F02B 69/06

[52] U.S. Cl. ..... 123/21; 123/90.11

[58] Field of Search ..... 123/21, 90.11, 123/90.15, 90.12

[56] References Cited

U.S. PATENT DOCUMENTS

| | | | |
|---|---|---|---|
| 4,392,459 | 7/1983 | Chareire | 123/21 |
| 4,572,114 | 2/1986 | Sickler | 123/21 |
| 5,005,539 | 4/1991 | Kawamura | 123/21 |
| 5,007,382 | 4/1991 | Kawamura | 123/21 |
| 5,022,353 | 6/1991 | Kamamura | 123/21 |
| 5,113,805 | 5/1992 | Kawamura | 123/21 |
| 5,158,044 | 10/1992 | Kawamura | 123/21 |
| 5,193,492 | 3/1993 | Kawamura | 123/21 |

FOREIGN PATENT DOCUMENTS

| | | | |
|---|---|---|---|
| 3-92546 | 4/1991 | Japan | 123/21 |

*Primary Examiner*—David A. Okonsky
*Attorney, Agent, or Firm*—Bielen, Peterson & Lampe

[57] ABSTRACT

A universal internal combustion engine that is electronically and reversibly convertible from four stroke operation to two stroke operation, the engine having intake and exhaust valves with an electro-hydraulic actuator system for actuating the valves in accordance with electronic control signals from an electronic control module, the electro-hydraulic actuator system having an electronic actuator for each valve coupled to a slide valve for discrete supply of a pressurized hydraulic fluid to a hydraulic piston for each valve, the electronic control module having a program for independent activation of each electronic actuator for select operation of each intake and exhaust valve at any time during the operating cycle.

6 Claims, 3 Drawing Sheets

TWO STROKE/FOUR STROKE ENGINE

BACKGROUND OF THE INVENTION

This invention relates to a convertible two cycle/four cycle engine that has an electronically operated gas disbursement system for instantaneous conversion and variable control. The electronically operated gas disbursement system enables optimized performance of the engine in either the two stroke cycle or the four stroke cycle.

For ordinary driving conditions, a typical vehicle is powered by an engine that is sized for the maximum performance requirement of the vehicle. For example, a passenger vehicle passing another vehicle on a hill may for a brief period utilize the maximum power of the engine. At virtually all other times, from low speed city driving to highway cruising the power demand is a fraction of the available power. Over-dimensioned engines with large displacements are therefore constructed to meet only occasional power demands.

The situation for large displacement working vehicles is even more dramatic. Freight hauling tractor-trailers, delivery trucks and other road vehicles are designed with engines to accommodate full loads. When traveling empty, the power requirement is substantially diminished. Similarly, marine engines often must shift from high speed or power operation to low speed where the engine operates in idle for long periods of time. Unused displacement or over displacement results in over-sized, large engines with a multiplicity of cylinders, having a weight and complexity resulting in an unnecessary consumption of fuel and excess pollution.

Existing internal combustion engines are usually limited in their operation to two or four stroke cycles. The engines have a fixed mechanical gas distribution system, with set angular phases for intake and exhaust, which are optimized for a limited range of operation. With fixed compression ratios and limited means of optimizing performance for all ranges of power, torque and engine speed, fuel consumption is typically characterized by the "hook shape" specific fuel consumption curve with one point of minimum fuel consumption. Adaptation for the three ranges of operation, city power, cruise power, and acceleration power become a compromise with no one engine optimized for all conditions.

Although certain improvements to engine design have addressed these problems, for example, the use of a turbocharger for high performance operation, satisfaction of power demand is at the expense of optimized fuel consumption.

The engine of this invention resolves the problems of a universal engine optimized for all operating conditions by combining the power range achievable by a combined two cycle/four cycle engine with that of a two cycle engine. The convertible two cycle/four cycle engine of this invention is provided with an infinitely variable motive gas distribution system that is freed from cam controlled, mechanical actuation systems. The integrated engine system utilizes a fast acting, electro-hydraulic actuator for optimization of the intake and exhaust cycle in both the two cycle and four cycle mode of operation.

SUMMARY OF THE INVENTION

The universal, two cycle/four cycle engine of this invention incorporates electro-hydraulic actuators for selectively operating each intake valve and exhaust valve in an internal combustion engine. The internal combustion engine is of conventional design with reciprocating pistons and two or more poppet valves controlling intake and exhaust of the gases of combustion. Eliminated from the engine are the cams, push rods, rockers, gears and chains that mechanically control actuation of the valves.

The high performance electro-hydraulic actuators incorporated in this engine utilize concepts devised by these inventors for high pressure fuel injection where the timing, duration and rate of fuel injection must be precisely controlled at exceedingly high fuel pressures. Because of the precision control and high operating forces achievable by hydraulic actuators of the fuel injector, the adaptation to a valve actuator enables controlled operation at any time during the cycle, and importantly enables the profile of the stroke to be tailored at will. Since the electro-hydraulic actuator is electronically controlled, the use of an electronic control module of conventional state-of-the-art type enables mapping of engine performance and optimization of operation under all loads and conditions. Furthermore, with both intake and exhaust valves of each cylinder being independently actuated by a separate actuator, the use of an electronic control module with electronically operated electro-hydraulic actuators enables the engine to be instantaneously switched from two stroke to four stroke, or from four stroke to two stroke operation.

Additionally, the universal controllability of the intake and exhaust valves enables a variety of additional operating regimes to be implemented such as fueled operation of select cylinders with others reciprocating without compression, select use of cylinder compression without fueling for breaking, feathering all cylinders in hybrid engine systems having wheel connected energy recovery systems, and other regimes where select control over one or more cylinders in a multi-cylinder engine is desired, or where discrete cycle operation of the intake and exhaust valves is advantageous.

By activating the cylinder valves by an actuator directly mounted at the top of each valve, the sequential operation of the intake and exhaust valves is electronically controlled without accumulated tolerances from pushers and rockers with optimized opening and closing during each cycle, in a two stroke or four stroke mode.

At low rotation, short angular displacement profiles for the valves are employed to maximize the expansion stroke by reducing the advance of exhaust opening, and maximizing the trapped air intake capacity by optimized closing of the intake valve, thereby maximizing the compression ratio for maximum torque and minimum specific fuel consumption.

At high rotation, a mapped profile for optimum performance gradually enlarges the angular value of the intake and exhaust phasing according to sensed operating regimes.

The engine is operated in a four stroke cycle during starting and operation at part load. Programmed operation under control of the electronic control module gradually increases power to the maximum for the four stroke mode, which in certain embodiments includes the activation of a supercharger at peak four-stroke operation.

As a continuation of four stroke operation when and if more power and torque is necessary, the engine shifts to two stroke operation. This may be accomplished for all cylinders at once, or in a transition where cylinders sequentially convert from four stroke to two stroke operation.

The system is controlled by an electronic control module and timed to the crankshaft rotation. As in conventional electronically controlled engine operation, the electronic control module receives input from other sensors to assist in optimizing real-time operation of the engine, which are not a specific part of this invention. It is to be understood that the apparatus disclosed will be operable by state-of-the-art electronic control modules programmed for particular embodiments of the described engine systems. It is also understood that as more advanced programmable controllers become available for use in automotive electronic control modules, that even greater efficiencies can be achieved by these high-speed electro-hydraulic actuators that are key to the convertible engine described.

DETAILED DESCRIPTION OF THE PREFERRED EMBODIMENTS

Figure 1:
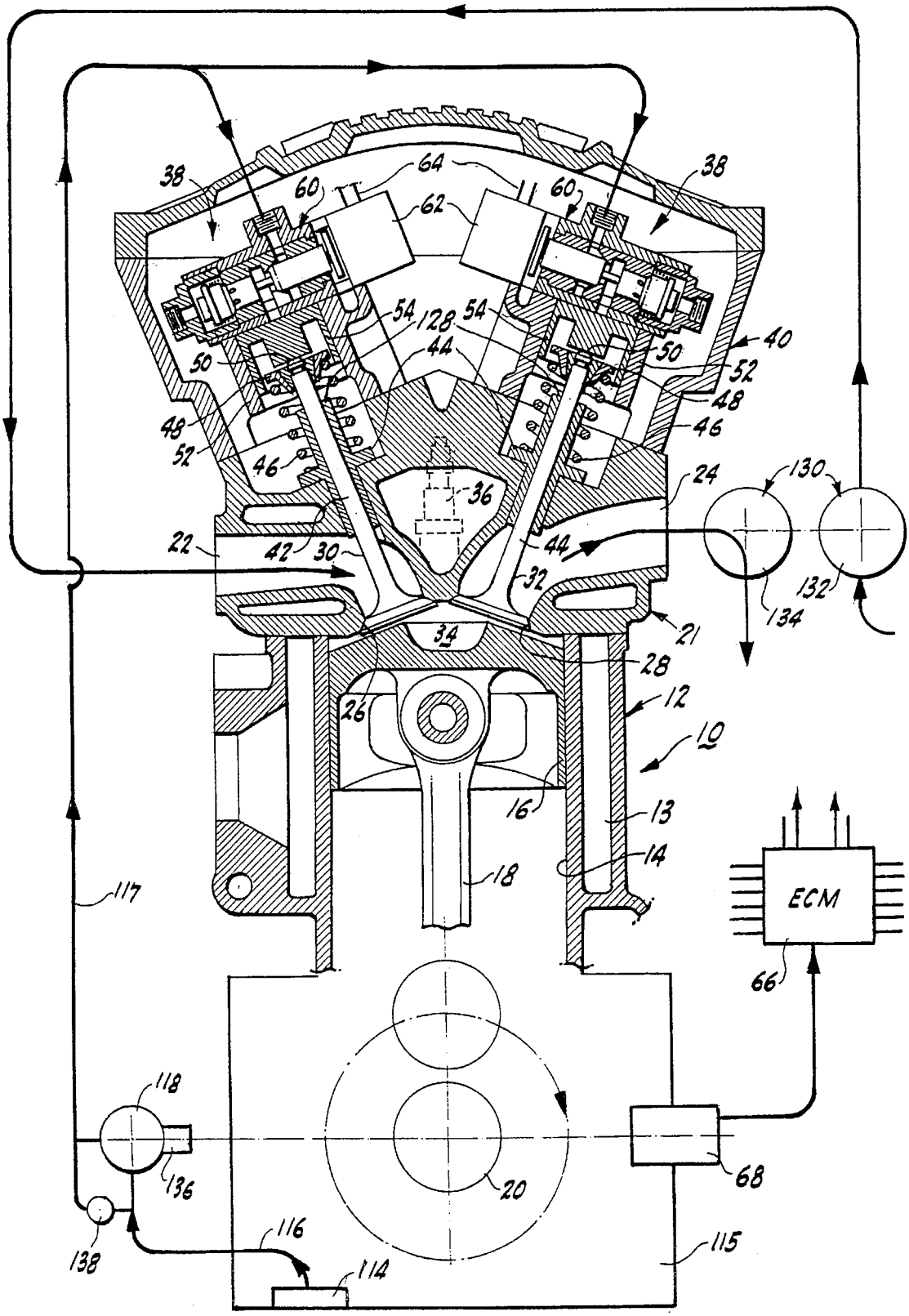
FIG. 1 is a partially schematic and partially cross sectional view of the internal combustion engine of this invention showing the valve actuator assembly and the engine piston at top dead center.

The universal engine of this invention is shown in FIG. 1 and designated generally by the reference numeral 10. The unique portion of the universal engine 10 is shown in cross section and the auxiliary components are shown schematically. The universal engine 10 is an internal combustion engine of generally typical design with a cylinder block 12 with cooling passages 13 and one or more cylinders 14 in which is reciprocated a piston 16. The piston 16 is connected to a connecting rod 18 that in turn is connected to a crankshaft 20, which is schematically illustrated in FIG. 1.

The cylinder block 12 is coupled to a cylinder head 21 having a gas intake passage 22 and gas exhaust passage 24. The intake passage 22 and exhaust passage 24 terminate an intake port 26 and exhaust port 28. The intake port 26 and exhaust port 28 have respective poppet valves 30 and 32 for regulating the flow of gases to and from the combustion chamber 34. The engine 10 includes a spark plug 36 for ignition, however, it is to be understood that the gas distribution system of this invention can be utilized with fuel injected engines and with diesel engines where the motive gases are spontaneously combusted upon compression.

The cylinder head 21 includes a poppet valve actuator assembly 38 for each of the poppet valves 30 and 32. In a multiple cylinder engine, it is to be understood that a separate actuator assembly is used on each intake and exhaust valve in each of the cylinders in certain multi-valve engines, valves of one type, i.e., exhaust valves may be ganged to one actuator assembly where synchronous operation is desired. The actuator assemblies 38 are located within a valve cover 40 mounted to the cylinder head 20 in a customary manner.

The poppet valves 30 and 32 are of conventional construction with a valve stem 42 slidable in a valve sleeve 44 and biased to closure by a compression spring 46. The compression spring 46 is retained by a spring retainer 48 at the end of the valve stem 42. The valve top 50 is positioned within a hydraulic cylinder housing 52 that is part of the actuator assembly 38. The cylinder housing 52 has a piston cylinder 56 with a slidable hydraulic piston 54 in contact with the valve top 50.

Figure 2:
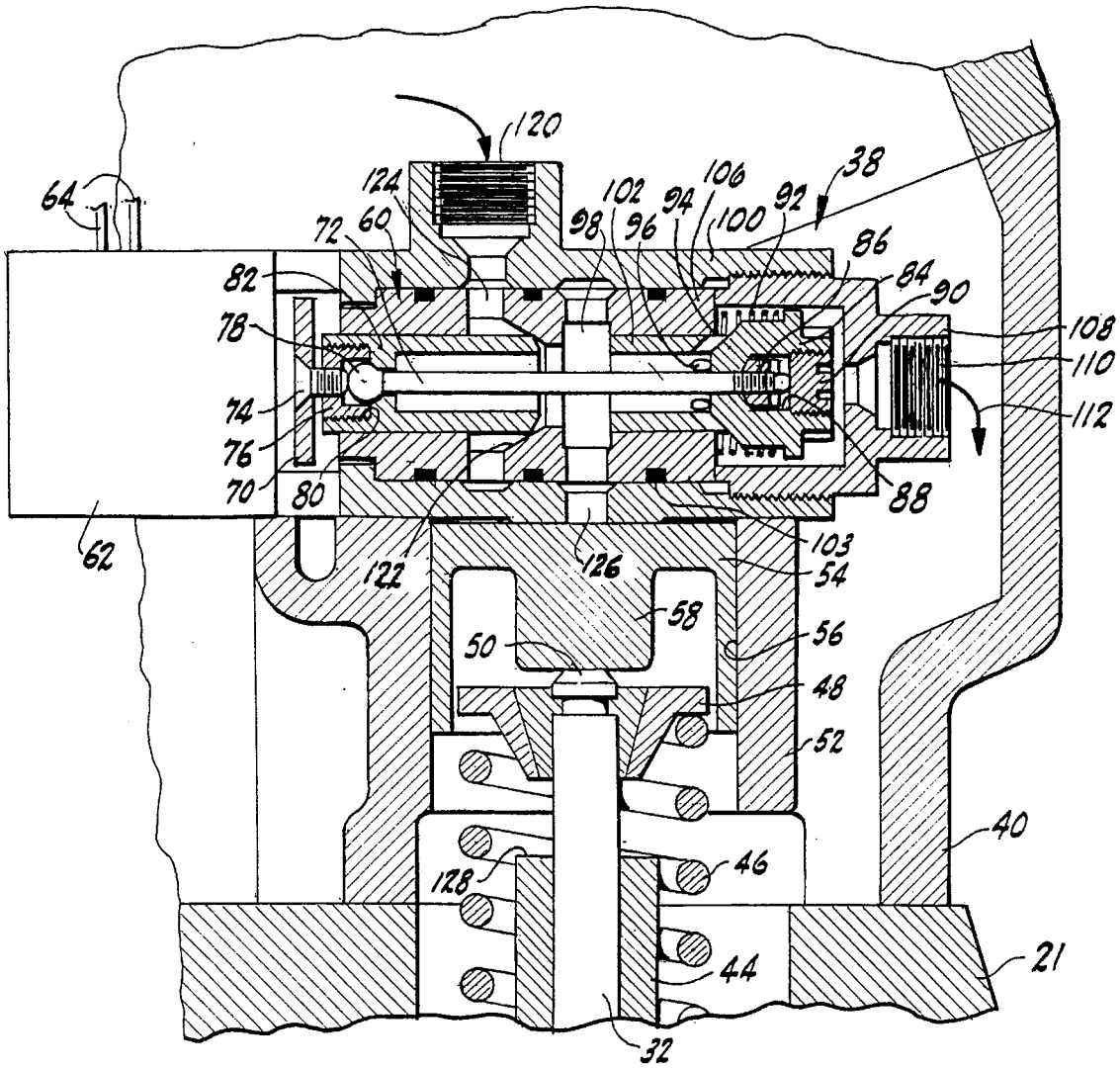
FIG. 2 is an enlarged, cross sectional view of the electro-hydraulic actuator assembly of FIG. 1.

Referring to the enlarged view of FIG. 2, the actuator assembly 38 for the exhaust valve 32 is shown. As the construction and the operation of the actuator assembly 48 for the exhaust valve 32 is identical to that of the intake valve 30, the following description applies equally to the actuator assembly 38 for the intake valve 30. As shown, the valve top 50 contacts a projecting center boss 58 on the backside of the hydraulic piston 54 so that displacement of the piston 54 will in turn result in displacement of the poppet valve 32, shown in part in FIG. 2.

The actuator assembly 38 is constructed with an electro-hydraulic actuator 60. The actuator 60 includes an electronically activated solenoid 62 having electrical terminals 64 that are electrically connected to an electronic control module 66, shown in FIG. 1. The electronic control module 66 controls the activation of the solenoid 62 by sending discrete, shaped electrical power pulses to the solenoid 62. The electronic control module 66 receives a timing signal from a timing sensor 68 that detects the angular position of the crankshaft 20 in a conventional manner. The solenoid 62 includes an armature 70 that is displaced upon electronic activation of the solenoid 62. The armature 70 is connected to a double-headed valve stem 72 using a threaded pin 74 and cap 76 which traps a valve stem head 78 in a pocket 80 of a cylindrical slide valve 82. At the opposite end of the valve stem 72 is a poppet valve 84 that is connected to the valve stem 72 by a trapped nut 86. The trapped nut 86 is located in a pocket 88 in the poppet valve 84 and capped by an end cap 90. Poppet valve 84 is biased by a compression spring 92 that biases the poppet valve 84 to an open position relative to a valve seat 94 which exposes bypass passages 96 for a return of hydraulic fluid from a receiving chamber 98 within the actuator housing 100. The valve seat 94 comprises the end part of a chamber liner 102 within a guide sleeve 106 sealed by seals 103 within to the housing 100.

An end cap 108 caps the end of the housing 100 and includes a hydraulic line 110 for return of hydraulic fluid through return line 112 to a hydraulic reservoir 114, the oil sump 115 of the engine as shown in FIG. 1. Hydraulic fluid is drawn from the reservoir 114 through supply line 116 supplied to the electro-hydraulic actuator 60 through a feed line 117 under pressure from a hydraulic pump 118 connected to the hydraulic input fitting 120 at the top of the housing 100. The slide valve 82 is displaceable in the guide sleeve 106 allowing the hydraulic fluid to pass to the receiving chamber 98. When the solenoid armature is retracted, the slide valve 82 is displaced from the end seat 122, and fluid is allowed to pass through an internal passage 124 to the chamber 104. The poppet valve 84 is simultaneously displaced against the compression spring 92 to a closed position blocking return of fluid to the reservoir. In this phase of operation, the hydraulic fluid passes from chamber 98 to a passage 126 which communicates with the piston cylinder 56 thereby displacing the piston 54 and the poppet valve 32 for the gas exhaust passage 24 of the engine 10 of FIG. 1. Because of the diameter of the piston 54, pressure of the hydraulic fluid adds a magnified force to displace the poppet valve 30 against the force of the compression spring 106. A stroke limiter 128 limits the maximum displacement of the poppet valve 32. In FIG. 2 the exhaust actuator is used as an exemplar of the actuator assembly 38 common to both intake and exhaust.

In the system of FIG. 1, the universal engine 10 is operating as a four stroke engine utilizing natural aspiration at lower speeds and loads bypassing a turbo charger 130. In such operation, poppet valve 30 will open as the piston 16 descends drawing air and fuel mixture into the combustion chamber 34. At the bottom of the stroke with both valves closed, the piston will compress the air-fuel mixture for ignition by the spark plug 36. After the power stroke when the piston again returns to top dead center, the intake valve 30 remains closed and the exhaust valve 32 opens to discharge combusted gases. As noted, the timing of the valve opening and closure for both the intake valve and exhaust valve can be precisely determined by a mapping program within the electronic control module 66. At higher loads, the turbo charger 130 can be activated manually or automatically to provided compressed air through a compressor portion 132 of the turbo charger 130 as driven by the turbine portion 134 of the charger.

Figure 3:
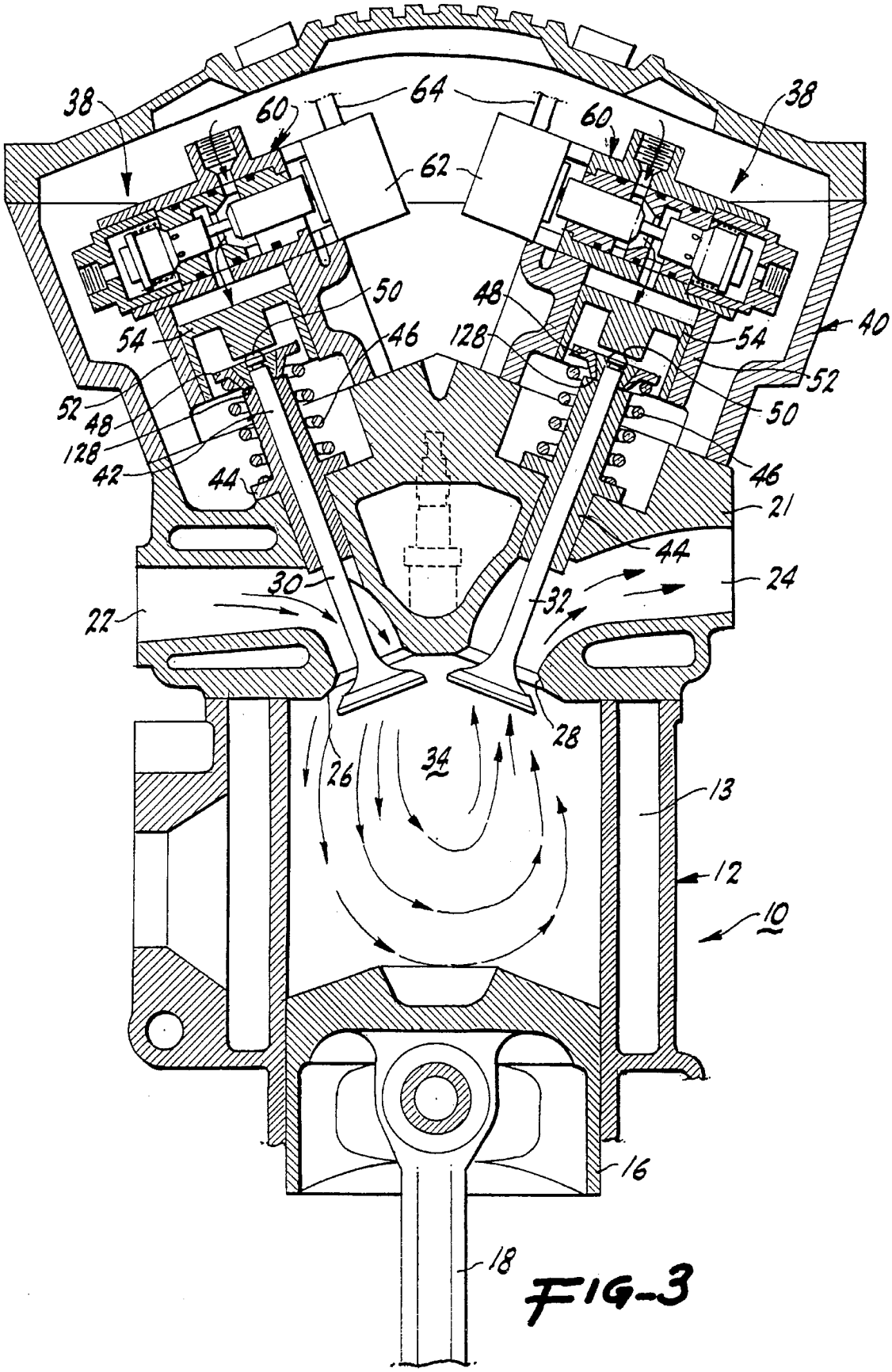
FIG. 3 is a cross sectional view of the engine of FIG. 1, showing the engine piston in a retracted position.

When it is desired to double the power of the engine, the universal engine can be automatically or manually changed from four stroke operation to two stroke operation. Referring now to FIG. 3, the universal engine 10 is shown in operation as a two stroke engine. In FIG. 3, the piston is retracted to approximately its bottom dead center position and the intake valve 30 and exhaust valve 32 are opened to allow scavenging. In such operation, the turbo charger is engaged such that compressed air is allowed through the intake passage 22 for forced scavenging of exhaust gases through the exhaust passage 24 while the exhaust valve 32 remains open. Timing of the closure of the exhaust valve 32 and the intake valve 30 are again controlled by the electronic control module in accordance with the profile for the particular engine in which the system is incorporated.

Since the electronic control module controls the operation of both the intake passage and exhaust passage, cylinders in a multi-cylinder engine can be deactivated for breaking by closure of both valves, or for feathering, by opening of both valves with fuel halted.

Under electronic control, the electro-hydraulic actuator 60 is activated by electronically powering the solenoid 62. The solenoid 62, as noted, displaces the armature 70, the slide valve 82 and poppet valve 84 against the compression spring 92, closing the return line and opening the feed line to the piston cylinder 56 to displace the hydraulic piston 54 and the poppet valve 32. Deactivated, the armature 70 returns to the extended state by expansion of the compression spring 92, resulting in closure of the supply line and opening of the return line. Since the operation of the electro-hydraulic actuator 60 is independent of the rotation cycle of the crankshaft 20, actuation can be timed as desired to maximize the engine performance and to permit the transition from a four cycle to a two cycle engine when added power is required. When the power demand diminishes, the engine is transformed from a two cycle engine to a four cycle engine by instantaneous switching of the program for actuating the intake and exhaust valves of the engine. As noted, the electronic control module 66 is preprogrammed for optimized performance at all operating regimes of load and rotation in four cycle and two cycle operation. In order that the electro-hydraulic actuator be supplied with fluid under pressure, the hydraulic pump 118 includes an electric drive motor 136, activated during start-up and includes a pressure release valve 138 for maintaining a pressure in the feed line 117 delivering hydraulic fluid to the electro-hydraulic actuators.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. An internal combustion engine that is electronically and reversibly convertible from four stroke operation to two stroke operation comprising:

a cylinder block with at least one piston cylinder and a piston reciprocatable in the cylinder;

at least one intake passage with an intake port to the cylinder and at least one exhaust passage with an exhaust port to the cylinder;

at least one intake valve at the intake port, the intake valve having a valve stem and spring means for biasing the intake valve to closure;

at least one exhaust valve at the exhaust port, the exhaust valve having a valve stem and spring means for biasing the exhaust valve to closure;

at least one electro-hydraulic actuator on the intake valve and at least one electro-hydraulic actuator on the exhaust valve, each of the electro-hydraulic actuators having an electronic actuator and a hydraulic valve means with the electronic actuator coupled to the hydraulic valve means, the hydraulic valve means having a displaceable hydraulic piston in engagement with one of the valve stems for displacement of one of the intake valve and exhaust valve on electronic activation of the electronic actuator wherein the electronic actuator comprises a solenoid with an armature and wherein the hydraulic valve means includes a displaceable slide valve in engagement with the armature of the solenoid and includes a pressurized hydraulic fluid supply wherein the pressurized hydraulic fluid supply is supplied to the hydraulic piston on displacement of the slide valve; and, electronic control means for select activation of the electro-hydraulic actuators in accordance with a program regime that enables operation of the intake valve and exhaust valve for four stroke operation and two stroke operation.

2. The internal combustion engine of claim 1 wherein the displaceable slide valve includes spring means for biasing the slide valve to closure blocking the fluid supply to the hydraulic piston.

3. The internal combustion engine of claim 2 wherein the slide valve includes additional valve means for returning hydraulic fluid to the fluid supply.

4. The internal combustion engine of claim 1 including a crankshaft connected to the piston, wherein the electronic control means includes timing means for determining the angular rotation of the crankshaft.

5. The internal combustion engine of claim 4 wherein the electronic control means includes a program for switching the engine operation from four stroke operation to two stroke operation.

6. The internal combustion engine of claim 1 in combination with a turbocharger, wherein the turbocharger has a compressor portion supplying compressed air to the intake passage and a turbine portion receiving exhaust gases from the exhaust passage.

* * * * *